US009458806B2

(12) United States Patent
Zhang et al.

(10) Patent No.: US 9,458,806 B2
(45) Date of Patent: Oct. 4, 2016

(54) METHODS FOR CORRECTING SPILL VALVE TIMING ERROR OF A HIGH PRESSURE PUMP

(71) Applicant: Ford Global Technologies, LLC, Dearborn, MI (US)

(72) Inventors: Hao Zhang, Ann Arbor, MI (US); Gopichandra Surnilla, West Bloomfield, MI (US); Mark Meinhart, South Lyon, MI (US); Ross Dykstra Pursifull, Dearborn, MI (US); Joseph F. Basmaji, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 266 days.

(21) Appl. No.: 14/189,926

(22) Filed: Feb. 25, 2014

(65) Prior Publication Data

US 2015/0240769 A1 Aug. 27, 2015

(51) Int. Cl.
*F02M 59/36* (2006.01)
*F02M 59/20* (2006.01)
(Continued)

(52) U.S. Cl.
CPC ..... *F02M 59/205* (2013.01); *F02D 41/3082* (2013.01); *F02M 59/366* (2013.01); *F02M 59/367* (2013.01); *F02M 59/368* (2013.01); *F02D 2200/0602* (2013.01);
(Continued)

(58) Field of Classification Search
CPC ..... F02M 59/205; F02M 59/366; F02M 59/367; F02M 59/368; F02M 37/0029; F02M 2025/0845; F02D 41/3082; F02D 2250/31; F02D 2200/0602
USPC ..... 123/456, 458, 457, 490, 495, 497
See application file for complete search history.

(56) References Cited

U.S. PATENT DOCUMENTS 3,827,409 A * 8/1974 O'Neill ..... F02D 41/3827 123/447
4,565,173 A * 1/1986 Oshiage ..... F02D 41/3082 123/357

(Continued)

FOREIGN PATENT DOCUMENTS

CN 101231225 A 7/2008
EP 1355059 A1 10/2003
EP 2647824 A1 9/2013

OTHER PUBLICATIONS

Surnilla, Gopichandra et al., "Robust Direct Injection Fuel Pump System," U.S. Appl. No. 14/155,250, filed Jan. 14, 2014, 61 pages.

(Continued)

*Primary Examiner* — Mahmoud Gimie
(74) *Attorney, Agent, or Firm* — Julia Voutyras; Alleman Hall McCoy Russell & Tuttle LLP

(57) ABSTRACT

Methods are provided for correct spill valve timing of a high pressure pump coupled to the direct injection system of an internal combustion engine. A method is needed to monitor and adjust spill valve timing on-board the vehicle, where spill valve timing error may result from sensors error and/or time between command signal and actuation response of the spill valve. To self-correct spill valve timing error on-board a vehicle, methods are proposed that involve monitoring and recording fuel rail pressures, high pressure pump duty cycles, and fractional liquid volume pumped values in order to find zero flow relationships.

16 Claims, 9 Drawing Sheets

(51) Int. Cl.

| | |
|---|---|
| ***F02D 41/30*** | (2006.01) |
| *F02M 59/38* | (2006.01) |
| *F02M 25/08* | (2006.01) |
| *F02M 37/00* | (2006.01) |

(52) U.S. Cl.
CPC ..... *F02D 2250/31* (2013.01); *F02M 37/0029* (2013.01); *F02M 2025/0845* (2013.01)

(56) References Cited

U.S. PATENT DOCUMENTS

| | | | | |
|---|---|---|---|---|
| 5,230,613 | A | 7/1993 | Hilsbos et al. | |
| 5,507,266 | A | 4/1996 | Wright et al. | |
| 5,598,817 | A | 2/1997 | Igarashi et al. | |
| 5,715,797 | A | 2/1998 | Minagawa et al. | |
| 5,755,211 | A | 5/1998 | Koch | |
| 5,884,597 | A | 3/1999 | Hiraku et al. | |
| 5,941,214 | A | 8/1999 | Hoffmann et al. | |
| 6,209,525 | B1 | 4/2001 | Konishi et al. | |
| 6,230,688 | B1 | 5/2001 | Faix et al. | |
| 6,378,489 | B1 | 4/2002 | Stanglmaier et al. | |
| 6,408,822 | B1 | 6/2002 | Rembold et al. | |
| 6,422,203 | B1 | 7/2002 | Djordjevic | |
| 6,439,202 | B1 | 8/2002 | Carroll, III et al. | |
| 6,609,500 | B2 | 8/2003 | Ricco et al. | |
| 6,694,950 | B2 | 2/2004 | Djordjevic | |
| 6,725,837 | B2 | 4/2004 | Hiraku et al. | |
| 6,739,317 | B2 | 5/2004 | Kellner et al. | |
| 6,742,479 | B2 | 6/2004 | Yanagisawa | |
| 6,748,923 | B2 | 6/2004 | Grossner et al. | |
| 6,871,633 | B1 | 3/2005 | Date et al. | |
| 6,953,025 | B2 | 10/2005 | Takahashi | |
| 6,988,492 | B2 | 1/2006 | Shetley | |
| 6,990,958 | B2 | 1/2006 | Asano et al. | |
| 7,007,662 | B2 | 3/2006 | Sakai et al. | |
| 7,013,872 | B2 | 3/2006 | Yamazaki et al. | |
| 7,178,510 | B2 * | 2/2007 | Askew | F02M 45/12 123/496 |
| 7,258,103 | B2 | 8/2007 | Tahara et al. | |
| 7,318,414 | B2 * | 1/2008 | Hou | F02D 41/3836 123/458 |
| 7,347,186 | B2 | 3/2008 | Ricco et al. | |
| 7,350,510 | B2 | 4/2008 | Tomatsuri et al. | |
| 7,377,753 | B2 | 5/2008 | Kuroda | |
| 7,584,747 | B1 | 9/2009 | Ibrahim et al. | |
| 7,640,916 | B2 | 1/2010 | Ulrey et al. | |
| 7,770,562 | B2 | 8/2010 | Pursifull et al. | |
| 7,775,191 | B2 * | 8/2010 | Hou | F02D 41/3836 123/458 |
| 7,814,887 | B2 | 10/2010 | Cwielong et al. | |
| 7,950,371 | B2 | 5/2011 | Cinpinski et al. | |
| 8,220,322 | B2 | 7/2012 | Wang et al. | |
| 8,342,151 | B2 | 1/2013 | Gwidt et al. | |
| 8,590,510 | B2 | 11/2013 | Surnilla et al. | |
| 2003/0029423 | A1 | 2/2003 | Boehland et al. | |
| 2004/0154594 | A1 | 8/2004 | Miyashita | |
| 2005/0199219 | A1 | 9/2005 | Utsumi | |
| 2005/0211224 | A1 * | 9/2005 | Inaguma | F02D 41/3845 123/458 |
| 2008/0216797 | A1 | 9/2008 | Oono | |
| 2008/0257304 | A1 | 10/2008 | Noda et al. | |
| 2009/0090331 | A1 | 4/2009 | Pursifull | |
| 2009/0159057 | A1 | 6/2009 | Pursifull et al. | |
| 2010/0108035 | A1 | 5/2010 | Dusa et al. | |
| 2011/0097228 | A1 | 4/2011 | Tokuo et al. | |
| 2011/0162724 | A1 | 7/2011 | Kleckler | |
| 2011/0208409 | A1 | 8/2011 | Snyder et al. | |
| 2012/0048242 | A1 | 3/2012 | Surnilla et al. | |
| 2012/0143475 | A1 | 6/2012 | Ryoo et al. | |
| 2012/0167859 | A1 | 7/2012 | Basmaji et al. | |
| 2013/0213359 | A1 | 8/2013 | Zeng et al. | |

OTHER PUBLICATIONS

Pursifull, Ross D. et al., "Methods for Determining Fuel Bulk Modulus in a High-Pressure Pump," U.S. Appl. No. 14/189,946, filed Feb. 25, 2014, 52 pages.
Pursifull, Ross D. et al., "Direct Injection Pump Control for Low Fuel Pumping Volumes," U.S. Appl. No. 14/284,220, filed May 21, 2014, 40 pages.
Surnilla, Gopichandra et al., "Adaptive Learning of Duty Cycle for a High Pressure Fuel Pump," U.S. Appl. No. 14/009,615, filed Dec. 6, 2013, 44 pages.
Ulrey, Joseph N. et al., "Adjusting Pump Volume Commands for Direct Injection Fuel Pumps," U.S. Appl. No. 14/300,162, filed Jun. 9, 2014, 42 pages.
Pursifull, Ross D. et al., "Direct Injection Fuel Pump," U.S. Appl. No. 14/198,082, filed Mar. 5, 2014, 67 pages.
Pursifull, Ross D. et al., "Rapid Zero Flow Lubrication Methods for a High Pressure Pump," U.S. Appl. No. 14/231,451, filed Mar. 31, 2014, 54 pages.

* cited by examiner

METHODS FOR CORRECTING SPILL VALVE TIMING ERROR OF A HIGH PRESSURE PUMP

FIELD

The present application relates generally to implementation of methods for corrected spill valve timing of a high pressure fuel pump in an internal combustion engine.

SUMMARY/BACKGROUND

Some vehicle engine systems utilize both direct in-cylinder fuel injection and port fuel injection. The fuel delivery system may include multiple fuel pumps for providing fuel pressure to the fuel injectors. As one example, a fuel delivery system may include a lower pressure fuel pump (or lift pump) and a higher pressure (or direct injection) fuel pump arranged between the fuel tank and fuel injectors. The high pressure fuel pump may be coupled to the direct injection system upstream of a fuel rail to raise a pressure of the fuel delivered to the engine cylinders through the direct injectors. The high pressure pump may also be powered by a driving cam that is coupled to a crankshaft of the engine. A solenoid activated inlet check valve, or spill valve, may be coupled upstream of the high pressure pump to regulate fuel flow into the pump compression chamber. The spill valve may be energized synchronously to the position of the driving cam or engine angular position. As such, a controller or other type of computerized device is used to control the timing of the spill valve in relation to pump piston movement. However, the spill valve may become out-of-sync with the driving cam, causing a mistiming between spill valve actuation and movement of the pump piston. This event is known as spill valve timing error.

In one approach to monitor spill valve timing, shown by Takahashi in U.S. Pat. No. 6,953,025, the spill valve is controlled by using a cam angle signal, wherein a relation exists among a crank angle signal, cam angle signal, control signal supplied to the spill valve, and stroke of the pump cam. The inventors herein have recognized that a method is needed where the spill valve error can be corrected on-board the vehicle without depending on angular position sensors. The fuel supply control apparatus of U.S. Pat. No. 6,953,025 utilizes position sensors to modify spill valve timing. The inventors herein have proposed methods for correcting spill valve timing error by monitoring fuel rail pressure and apparent closing timing of the spill valve.

Thus in one example, the above issues may be addressed by a method, comprising: adjusting duty cycle of a high pressure pump to correct a timing error of a spill valve based on a zero flow function for the high pressure pump, the spill valve regulating fuel flow into a compression chamber of the high pressure pump and the zero flow function based on a change in pump duty cycle relative to a resulting change in fuel rail pressure. In this way, spill valve timing correction may be learned on-board the vehicle while utilizing fuel rail pressure readings to control the spill valve. Also, the spill valve timing correction methods explained herein may monitor and analyze data produced by the fuel system in different operating modes without invasively disrupting the fuel system. The operating modes may include various idling and/or fueling conditions such as fueling the engine via port fuel injection only or direct injection only. Furthermore, since the correction methods may not require additional physical components than are already incorporated in the fuel system, costs associated with the fuel system may be reduced as compared to other correction methods that may require expensive additional components. As such, this may allow the complexity of the control system of the vehicle to be reduced, thereby reducing power consumption and cost of the control system.

Using the flow function to adjust pump duty cycle may involve determining an offset of the flow function. The offset may be used to either delay or accelerate the closing of the spill valve so as to synchronize the spill valve timing and compression stroke of the pump piston. Finding the offset can be accomplished in several ways. For example, while not direct injecting fuel into an engine, a series of pump duty cycles are commanded while determining the responsive fuel rail pressures to form a series of operating points. Those operating points can then be plotted to form a zero flow function to find an offset value that represents the mistiming between spill valve actuation and pump piston movement.

In a related example, while direct injecting fuel into an engine, a multitude of pump duty cycles are commanded at selected fuel rail pressures along with fractional volume of liquid fuel pumped, forming a series of lines that can be used to find intercepts that correspond to zero flow rate data. The zero flow rate data, a series of operating points at zero flow relating fuel rail pressure and duty cycle, can then be plotted to form a zero flow function to find an offset value that may be used to correct spill valve timing error.

It is noted that pump duty cycle refers to controlling the closing of the pump solenoid activated inlet check valve (spill valve), where the spill valve controls the amount of fuel pumped into a fuel rail. For example, if the spill valve closes coincident with the beginning of the engine compression stroke, the event is referred to as a 100% duty cycle. If the spill valve closes 95% into the compression stroke, the event is referred to as a 5% duty cycle. When a 5% duty cycle is commanded, in effect 95% of the displaced fuel volume is spilled and the remaining 5% is compressed during the compression stroke of the pump piston. Duty cycle is equivalent to spill valve timing, in particular the closing of the spill valve.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following detailed description provides information regarding a high pressure fuel pump and the proposed methods for correcting spill valve timing error. An example embodiment of a cylinder in an internal combustion engine is given in FIG. 1 while FIG. 2 depicts a fuel system that may be used with the engine of FIG. 1. An example of a high pressure pump configured to provide direct fuel injection into the engine is showed in detail in FIG. 3. As background for the correction methods, a mapping (or plot) of a high pressure pump is shown in FIG. 4 while the pump's zero flow rate data is shown on another graph in FIG. 5. A first correction method that involves not direct injecting fuel into the engine is graphically shown in FIG. 6 while an equivalent flow chart is presented in FIG. 8. A second correction method that involves maintaining a positive flow rate via direct injection is graphically shown in FIG. 7 while an equivalent flow chart is presented in FIG. 9.

Regarding terminology used throughout this detailed description, several graphs are presented wherein data points are plotted on 2-dimensional graphs. The terms graph and plot are used interchangeably to refer to the entire graph or the curve/line itself. Furthermore, a high pressure pump, or direct injection pump, may be abbreviated as HP pump. Similarly, fuel rail pressure may also be abbreviated as FRP. As described in the summary above, pump duty cycle is used exclusively in reference to the high pressure pump and is also referred to as the closing of the spill valve, or valve timing. Also, the spill valve is equivalent to the solenoid activated inlet check valve.

Figure 1:
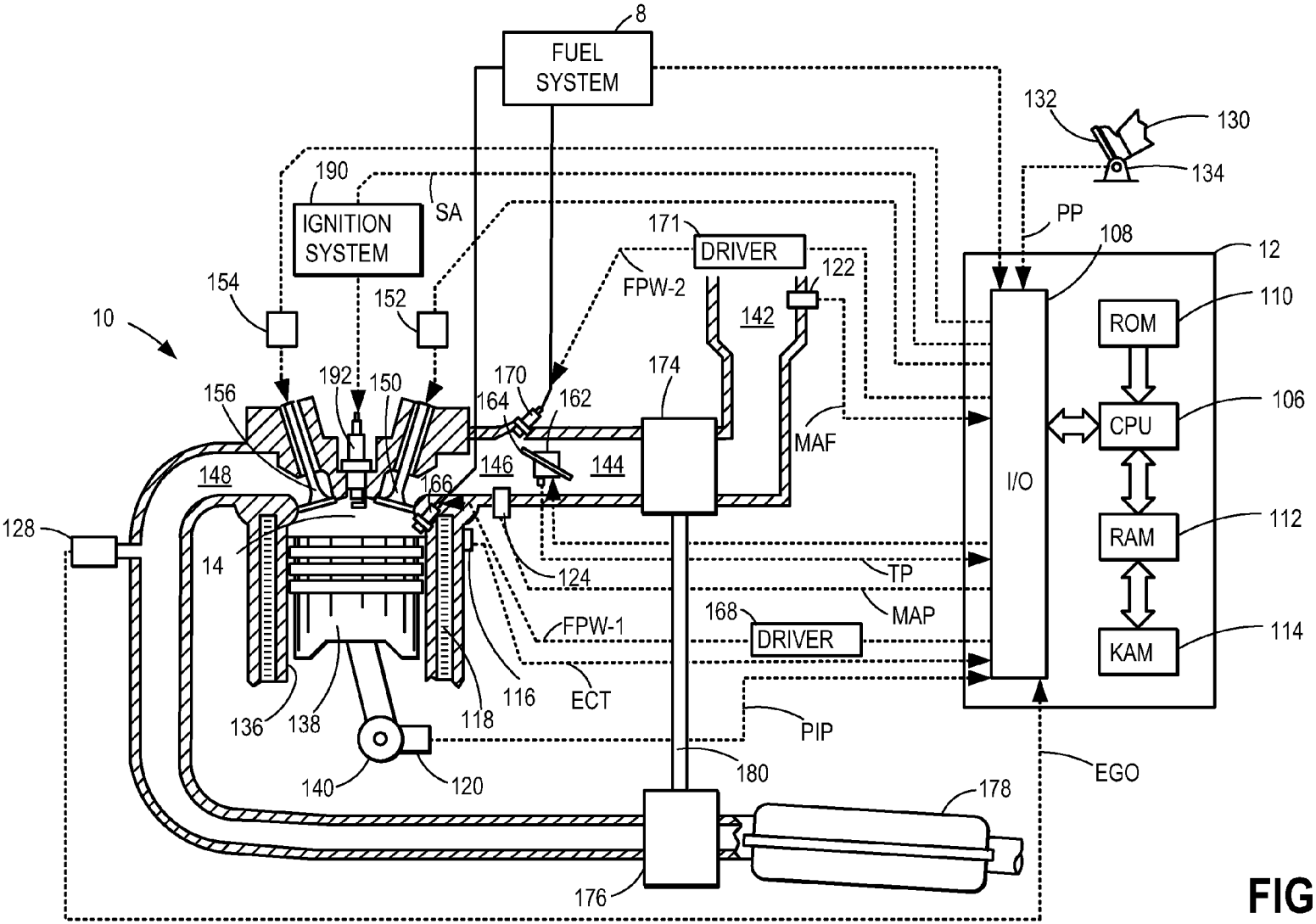
FIG. 1 schematically depicts an example embodiment of a cylinder of an internal combustion engine.
Figure 2:
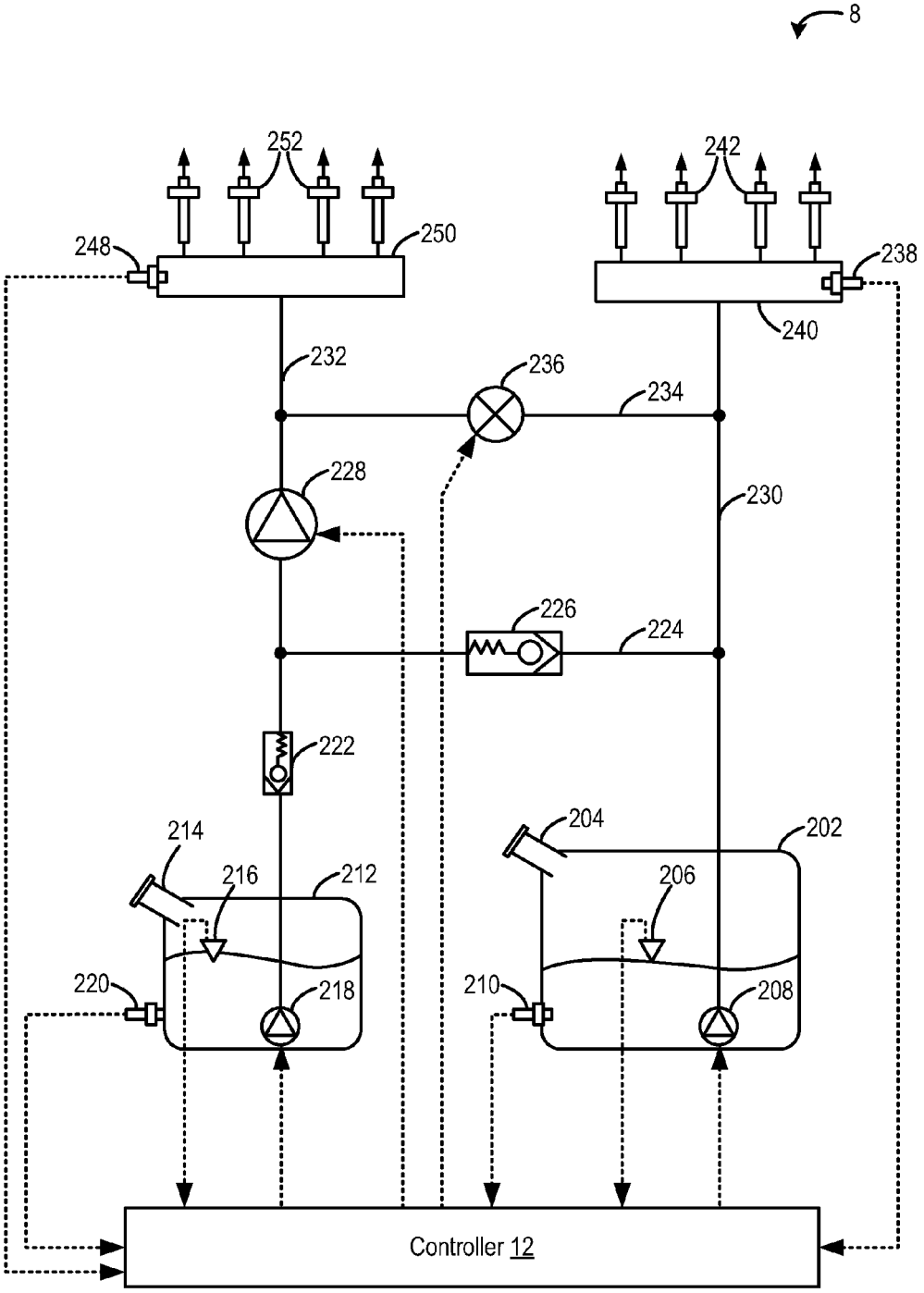
FIG. 2 schematically depicts an example embodiment of a fuel system that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel to an engine, such as engine 10 of FIG. 1. Fuel system 8 may be operated by a controller to perform some or all of the operations described with reference to the process flows of FIGS. 8 and 9.

Fuel system 8 can provide fuel to an engine from one or more different fuel sources. As a non-limiting example, a first fuel tank 202 and a second fuel tank 212 may be provided. While fuel tanks 202 and 212 are described in the context of discrete vessels for storing fuel, it should be appreciated that these fuel tanks may instead be configured as a single fuel tank having separate fuel storage regions that are separated by a wall or other suitable membrane. Further still, in some embodiments, this membrane may be configured to selectively transfer select components of a fuel between the two or more fuel storage regions, thereby enabling a fuel mixture to be at least partially separated by the membrane into a first fuel type at the first fuel storage region and a second fuel type at the second fuel storage region.

In some examples, first fuel tank 202 may store fuel of a first fuel type while second fuel tank 212 may store fuel of a second fuel type, wherein the first and second fuel types are of differing composition. As a non-limiting example, the second fuel type contained in second fuel tank 212 may include a higher concentration of one or more components that provide the second fuel type with a greater relative knock suppressant capability than the first fuel.

By way of example, the first fuel and the second fuel may each include one or more hydrocarbon components, but the second fuel may also include a higher concentration of an alcohol component than the first fuel. Under some conditions, this alcohol component can provide knock suppression to the engine when delivered in a suitable amount relative to the first fuel, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost.

As a specific non-limiting example, the first fuel type in the first fuel tank may include gasoline and the second fuel type in the second fuel tank may include ethanol. As another non-limiting example, the first fuel type may include gasoline and the second fuel type may include a mixture of gasoline and ethanol. In still other examples, the first fuel type and the second fuel type may each include gasoline and ethanol, whereby the second fuel type includes a higher concentration of the ethanol component than the first fuel (e.g., E10 as the first fuel type and E85 as the second fuel type). As yet another example, the second fuel type may have a relatively higher octane rating than the first fuel type, thereby making the second fuel a more effective knock suppressant than the first fuel. It should be appreciated that these examples should be considered non-limiting as other suitable fuels may be used that have relatively different knock suppression characteristics. In still other examples, each of the first and second fuel tanks may store the same fuel. While the depicted example illustrates two fuel tanks with two different fuel types, it will be appreciated that in alternate embodiments, only a single fuel tank with a single type of fuel may be present.

Fuel tanks 202 and 212 may differ in their fuel storage capacities. In the depicted example, where second fuel tank 212 stores a fuel with a higher knock suppressant capability, second fuel tank 212 may have a smaller fuel storage capacity than first fuel tank 202. However, it should be appreciated that in alternate embodiments, fuel tanks 202 and 212 may have the same fuel storage capacity.

Fuel may be provided to fuel tanks 202 and 212 via respective fuel filling passages 204 and 214. In one example, where the fuel tanks store different fuel types, fuel filling passages 204 and 214 may include fuel identification markings for identifying the type of fuel that is to be provided to the corresponding fuel tank.

A first low pressure fuel pump (LPP) 208 in communication with first fuel tank 202 may be operated to supply the first type of fuel from the first fuel tank 202 to a first group of port injectors 242, via a first fuel passage 230. In one example, first fuel pump 208 may be an electrically-powered lower pressure fuel pump disposed at least partially within first fuel tank 202. Fuel lifted by first fuel pump 208 may be supplied at a lower pressure into a first fuel rail 240 coupled to one or more fuel injectors of first group of port injectors 242 (herein also referred to as first injector group). While first fuel rail 240 is shown dispensing fuel to four fuel injectors of first injector group 242, it will be appreciated that first fuel rail 240 may dispense fuel to any suitable number of fuel injectors. As one example, first fuel rail 240 may dispense fuel to one fuel injector of first injector group 242 for each cylinder of the engine. Note that in other examples, first fuel passage 230 may provide fuel to the fuel injectors of first injector group 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 that is included in second fuel passage 232 and may be supplied fuel via LPP 208 or LPP 218. In one example, direct injection fuel pump 228 may be an engine-driven, positive-displacement pump. Direct injection fuel pump 228 may be in communication with a group of direct injectors 252 via a second fuel rail 250, and the group of port injectors 242 via a solenoid valve 236. Thus, lower pressure fuel lifted by first fuel pump 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel. Further, in some examples a fuel pressure accumulator (not shown) may be coupled downstream of the fuel filter, between the low pressure pump and the high pressure pump.

A second low pressure fuel pump 218 in communication with second fuel tank 212 may be operated to supply the second type of fuel from the second fuel tank 202 to the direct injectors 252, via the second fuel passage 232. In this way, second fuel passage 232 fluidly couples each of the first fuel tank and the second fuel tank to the group of direct injectors. In one example, third fuel pump 218 may also be an electrically-powered low pressure fuel pump (LPP), disposed at least partially within second fuel tank 212. Thus, lower pressure fuel lifted by low pressure fuel pump 218 may be further pressurized by higher pressure fuel pump 228 so as to supply higher pressure fuel for direct injection to second fuel rail 250 coupled to one or more direct fuel injectors. In one example, second low pressure fuel pump 218 and direct injection fuel pump 228 can be operated to provide the second fuel type at a higher fuel pressure to second fuel rail 250 than the fuel pressure of the first fuel type that is provided to first fuel rail 240 by first low pressure fuel pump 208.

Fluid communication between first fuel passage 230 and second fuel passage 232 may be achieved through first and second bypass passages 224 and 234. Specifically, first bypass passage 224 may couple first fuel passage 230 to second fuel passage 232 upstream of direct injection fuel pump 228, while second bypass passage 234 may couple first fuel passage 230 to second fuel passage 232 downstream of direct injection fuel pump 228. One or more pressure relief valves may be included in the fuel passages and/or bypass passages to resist or inhibit fuel flow back into the fuel storage tanks. For example, a first pressure relief valve 226 may be provided in first bypass passage 224 to reduce or prevent back flow of fuel from second fuel passage 232 to first fuel passage 230 and first fuel tank 202. A second pressure relief valve 222 may be provided in second fuel passage 232 to reduce or prevent back flow of fuel from the first or second fuel passages into second fuel tank 212. In one example, lower pressure pumps 208 and 218 may have pressure relief valves integrated into the pumps. The integrated pressure relief valves may limit the pressure in the respective lift pump fuel lines. For example, a pressure relief valve integrated in first fuel pump 208 may limit the pressure that would otherwise be generated in first fuel rail 240 if solenoid valve 236 were (intentionally or unintentionally) open and while direct injection fuel pump 228 were pumping.

In some examples, the first and/or second bypass passages may also be used to transfer fuel between fuel tanks 202 and 212. Fuel transfer may be facilitated by the inclusion of additional check valves, pressure relief valves, solenoid valves, and/or pumps in the first or second bypass passage, for example, solenoid valve 236. In still other examples, one of the fuel storage tanks may be arranged at a higher elevation than the other fuel storage tank, whereby fuel may be transferred from the higher fuel storage tank to the lower fuel storage tank via one or more of the bypass passages. In this way, fuel may be transferred between fuel storage tanks by gravity without necessarily requiring a fuel pump to facilitate the fuel transfer.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in each of fuel storage tanks 202 and 212 via fuel level sensors 206 and 216, respectively. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel storage tanks 202 and 212 may be provided by fuel composition sensors 210 and 220, respectively. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, sensors 238 and 248, arranged at the fuel rails or along the fuel passages coupling the fuel injectors with one or more fuel storage tanks, can provide an indication of a resulting fuel composition where two or more different fuels are combined before being delivered to the engine. In contrast, sensors 210 and 220 may provide an indication of the fuel composition at the fuel storage tanks, which may differ from the composition of the fuel actually delivered to the engine.

Controller 12 can also control the operation of each of fuel pumps 208, 218, and 228 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 12 may be used to send a control signal to each of the low pressure pumps, as required, to adjust the output (e.g. speed) of the respective low pressure pump. The amount of first or second fuel type that is delivered to the group of direct injectors via the direct injection pump may be adjusted by adjusting and coordinating the output of the first or second LPP and the direct injection pump. For example, the lower pressure fuel pump and the higher pressure fuel pump may be operated to maintain a prescribed fuel rail pressure. A fuel rail pressure sensor coupled to the second fuel rail may be configured to provide an estimate of the fuel pressure available at the group of direct injectors. Then, based on a difference between the estimated rail pressure and a desired rail pressure, the pump outputs may be adjusted. In one example, where the high pressure fuel pump is a volumetric displacement fuel pump, the controller may adjust a flow control valve of the high pressure pump to vary the effective pump volume of each pump stroke.

As such, while the direct injection fuel pump is operating, flow of fuel there-though ensures sufficient pump lubrication and cooling. However, during conditions when direct injection fuel pump operation is not requested, such as when no direct injection of fuel is requested, and/or when the fuel level in the second fuel tank 212 is below a threshold (that is, there is not enough knock-suppressing fuel available), the direct injection fuel pump may not be sufficiently lubricated if fuel flow through the pump is discontinued.

Figure 3:
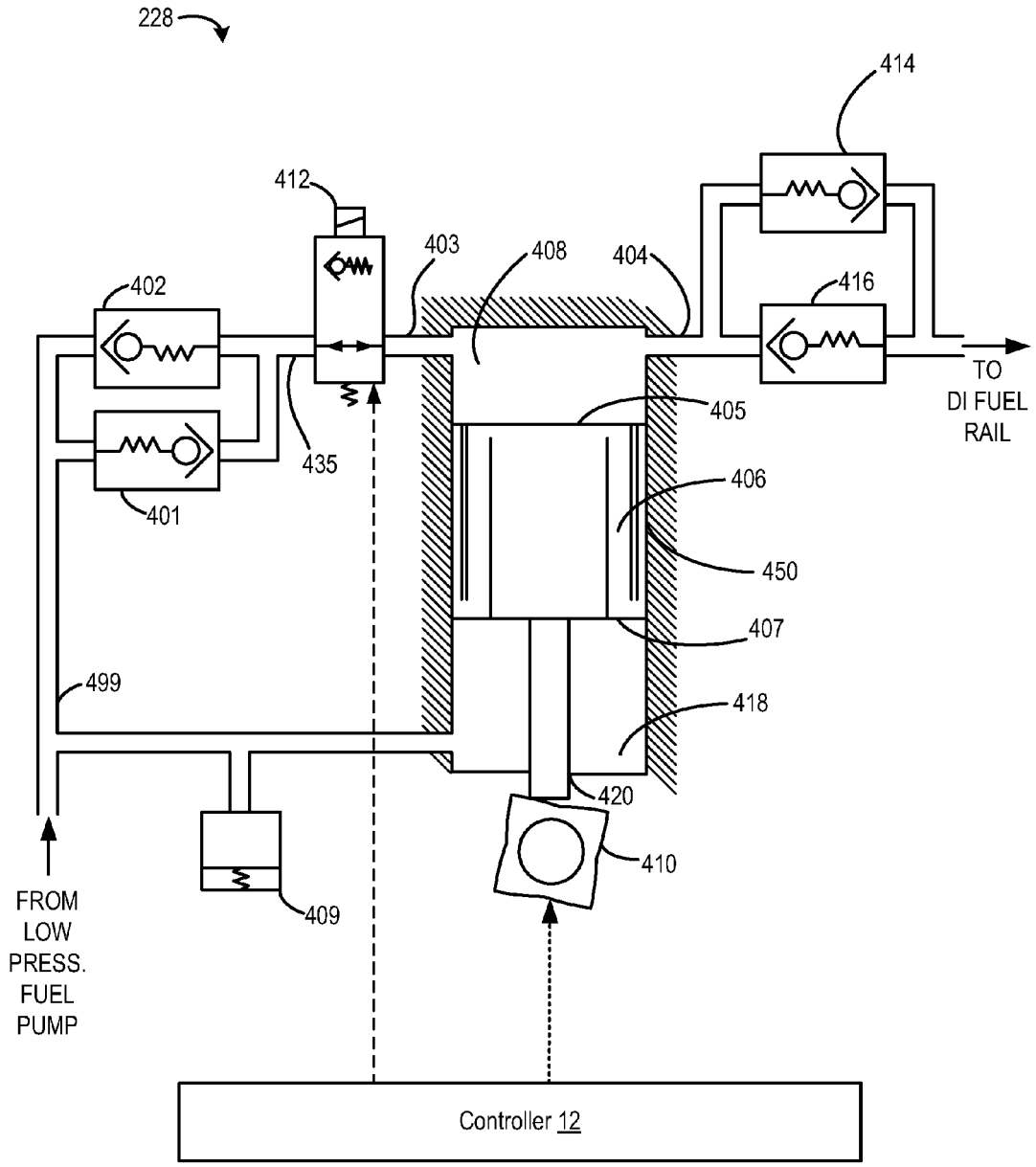
FIG. 3 shows an example of a high pressure direct injection fuel pump of the fuel system of FIG. 2.
Figure 4:
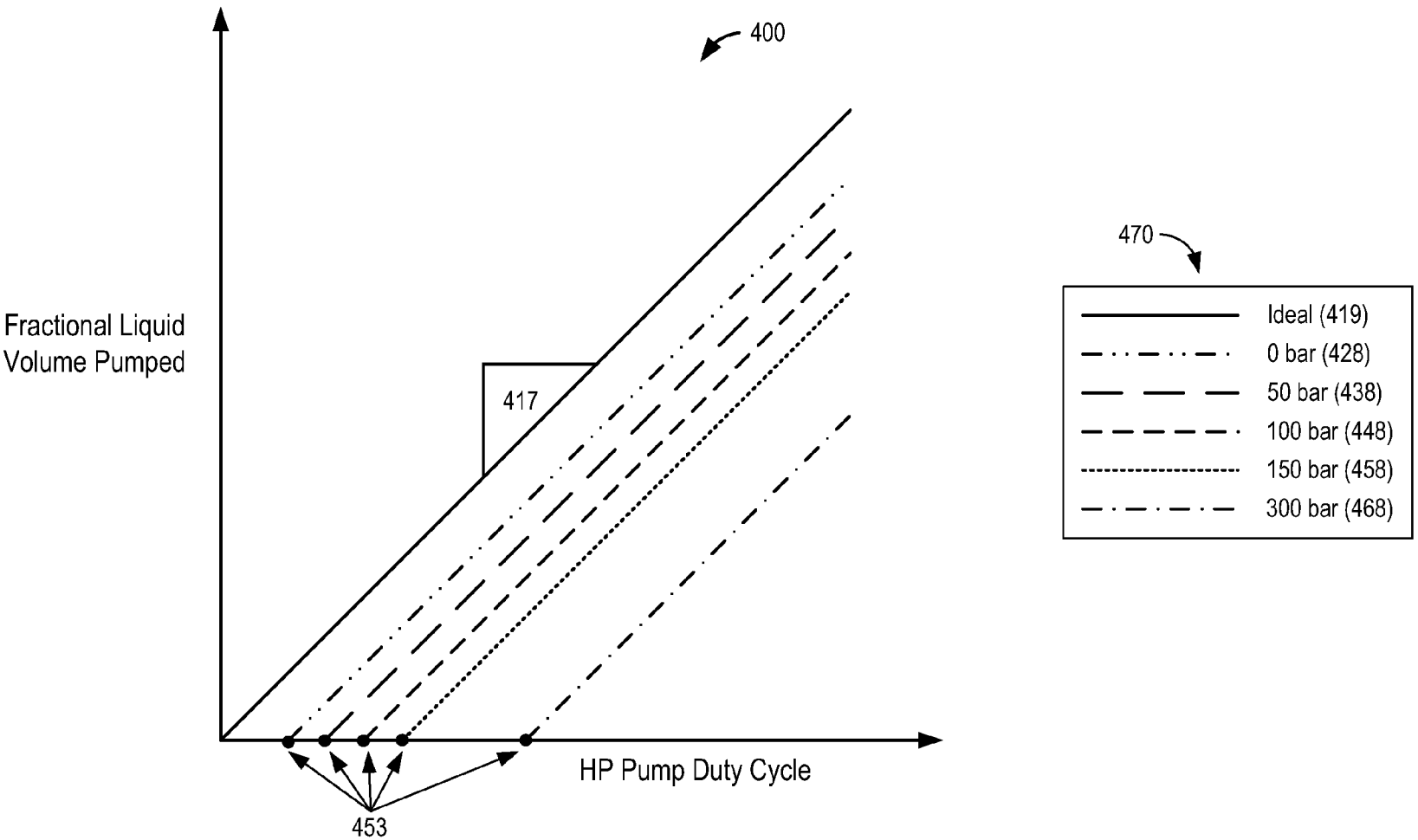
FIG. 4 illustrates a mapping of a high pressure pump for different fuel rail pressures.

FIG. 3 shows an example direct injection fuel pump 228 shown in the system of FIG. 2. Inlet 403 of direct injection fuel pump compression chamber 408 is supplied fuel via a low pressure fuel pump as shown in FIG. 2. The fuel may be pressurized upon its passage through direct injection fuel pump 228 and supplied to a fuel rail through pump outlet 404. In the depicted example, direct injection pump 228 may be a mechanically-driven displacement pump that includes a pump piston 406 and piston rod 420, a pump compression chamber 408 (herein also referred to as compression chamber), and a step-room 418. Piston 406 includes a top 405 and a bottom 407. The step-room and compression chamber may include cavities positioned on opposing sides of the pump piston. In one example, engine controller 12 may be configured to drive the piston 406 in direct injection pump 228 by driving cam 410. Cam 410 includes four lobes and completes one rotation for every two engine crankshaft rotations.

A solenoid activated inlet check valve 412 may be coupled to pump inlet 403. Controller 12 may be configured to regulate fuel flow through inlet check valve 412 by energizing or de-energizing the solenoid valve (based on the solenoid valve configuration) in synchronism with the driving cam. Accordingly, solenoid activated inlet check valve 412 may be operated in two modes. In a first mode, solenoid activated check valve 412 is positioned within inlet 403 to limit (e.g. inhibit) the amount of fuel traveling upstream of the solenoid activated check valve 412. In comparison, in the second mode, solenoid activated check valve 412 is effectively disabled and fuel can travel upstream and downstream of inlet check valve.

As such, solenoid activated check valve 412 may be configured to regulate the mass (or volume) of fuel compressed into the direct injection fuel pump. In one example, controller 12 may adjust a closing timing of the solenoid activated check valve to regulate the mass of fuel compressed. For example, a late inlet check valve closing may reduce the amount of fuel mass ingested into the compression chamber 408. The solenoid activated check valve opening and closing timings may be coordinated with respect to stroke timings of the direct injection fuel pump.

Pump inlet 499 allows fuel to check valve 402 and pressure relief valve 401. Check valve 402 is positioned upstream of solenoid activated check valve 412 along passage 435. Check valve 402 is biased to prevent fuel flow out of solenoid activated check valve 412 and into pump inlet 499. Check valve 402 allows flow from the low pressure fuel pump to solenoid activated check valve 412. Check valve 402 is coupled in parallel with pressure relief valve 401. Pressure relief valve 401 allows fuel flow out of solenoid activated check valve 412 toward the low pressure fuel pump when pressure between pressure relief valve 401 and solenoid operated check valve 412 is greater than a predetermined pressure (e.g., 10 bar). When solenoid operated check valve 412 is deactivated (e.g., not electrically energized), solenoid operated check valve operates in a pass-through mode and pressure relief valve 401 regulates pressure in compression chamber 408 to the single pressure relief setting of pressure relief valve 401 (e.g., 15 bar). Regulating the pressure in compression chamber 408 allows a pressure differential to form from piston top 405 to piston bottom 407. The pressure in step-room 418 is at the pressure of the outlet of the low pressure pump (e.g., 5 bar) while the pressure at piston top is at pressure relief valve regulation pressure (e.g., 15 bar). The pressure differential allows fuel to seep from piston top 405 to piston bottom 407 through the clearance between piston 406 and pump cylinder wall 450, thereby lubricating direct injection fuel pump 228.

Piston 406 reciprocates up and down. Direct fuel injection pump 228 is in a compression stroke when piston 406 is traveling in a direction that reduces the volume of compression chamber 408. Direct fuel injection pump 228 is in a suction stroke when piston 406 is traveling in a direction that increases the volume of compression chamber 408.

A forward flow outlet check valve 416 may be coupled downstream of an outlet 404 of the compression chamber 408. Outlet check valve 416 opens to allow fuel to flow from the compression chamber outlet 404 into a fuel rail only when a pressure at the outlet of direct injection fuel pump 228 (e.g., a compression chamber outlet pressure) is higher than the fuel rail pressure. Thus, during conditions when direct injection fuel pump operation is not requested, controller 12 may deactivate solenoid activated inlet check valve 412 and pressure relief valve 401 regulates pressure in compression chamber to a single substantially constant (e.g., regulation pressure±0.5 bar) pressure during most of the compression stroke. On the intake stroke the pressure in compression chamber 408 drops to a pressure near the pressure of the lift pump (208 and/or 218). Lubrication of DI pump 228 may occur when the pressure in compression chamber 408 exceeds the pressure in step room 418. This difference in pressures may also contribute to pump lubrication when controller 12 deactivates solenoid activated check valve 412. One result of this regulation method is that the fuel rail is regulated to a minimum pressure approximately the pressure relief of 402. Thus, if valve 402 has a pressure relief setting of 10 bar, the fuel rail pressure becomes 15 bar because this 10 bar adds to the 5 bar of lift pump pressure. Specifically, the fuel pressure in compression chamber 408 is regulated during the compression stroke of direct injection fuel pump 228. Thus, during at least the compression stroke of direct injection fuel pump 228, lubrication is provided to the pump. When direct fuel injection pump enters a suction stroke, fuel pressure in the compression chamber may be reduced while still some level of lubrication may be provided as long as the pressure differential remains. Another check valve 414 (pressure relief valve) may be placed in parallel with check valve 416. Valve 414 allows fuel flow out of the DI fuel rail toward pump outlet 404 when the fuel rail pressure is greater than a predetermined pressure.

It is noted here that DI pump 228 of FIG. 3 is presented as an illustrative example of one possible configuration for a DI pump. Components shown in FIG. 3 may be removed and/or changed while additional components not presently shown may be added to pump 228 while still maintaining the ability to deliver high-pressure fuel to a direct injection fuel rail. As an example, pressure relief valve 401 and check valve 402 may be removed in other embodiments of fuel pump 228. Furthermore, the methods presented hereafter may be applied to various configurations of pump 228 along with various configurations of fuel system 8 of FIG. 2.

Since the solenoid activated inlet check valve 412 (spill valve) is energized and de-energized in synchronism with the driving cam 410 or engine angular position, the inventors herein have recognized that an angular error and a spill valve timing error may result. Spill valve 412 is manipulated by controller 12 as seen in FIG. 3, and the accuracy of spill valve timing depends on the signal that controller 12 sends to spill valve 412. In one situation, spill valve timing error may result from a sensing error of the position of driving cam 410. If the sensor used by controller 12 to measure the angular position of driving cam 410 is not correctly calibrated or faulty, the signal to energize spill valve 412 may be delayed or accelerated, resulting in mistiming between fuel entering compression chamber 408 and actuation of piston 406 by driving cam 410. In a second situation, the signal from controller 12 is sent to spill valve 412 to energize (or de-energize) its check valve, wherein a ball or plate or other component moves over an inlet of the check valve to stop (or allow) fuel flow. Between receiving the signal from controller 12 to and the spill valve's responding movement, a period of time elapses that is manifested as a delay. If the delay is not properly incorporated into the spill valve activation control scheme or excessive use of the spill valve causes a change in the delay due to valve degradation, spill valve timing error may accumulate that causes the same mistiming as mentioned previously. It is noted that other various timing delays may also contribute to angular error, therefore resulting in spill valve timing error.

A method could be proposed for manually calibrating the spill valve activation scheme. However, the inventors herein have recognized that a correction method is needed where the spill valve timing error can be self-corrected within the system, on-board the vehicle. The proposed correction methods may be incorporated in controller 12 and activated according to a set of parameters to continually correct spill valve timing that may accumulate throughout a vehicle's usable driving lifetime. The correction methods described herein involve adjusting high pressure pump operation and commanding a series of duty cycles while determining (measuring) responsive fuel rail pressures and/or fractional fuel volumes pumped. Before describing the correction methods to rectify spill valve timing error, a number of concepts are presented that are involved in the correction methods.

FIG. 4 illustrates a mapping of a direct injection (high pressure) fuel pump showing the relationship 400 between HP pump duty cycle and fractional liquid volume of fuel pumped into the fuel rail. The plots (lines) of FIG. 4 represent testing of a single fuel, such as a gasoline-ethanol mixture with a certain bulk modulus, at different fuel rail pressures. The possible gasoline-ethanol mixtures are described in relation to FIGS. 1 and 2. Each individual curve of graph 400 corresponds to a single fuel rail pressure value as shown by legend 470. The vertical axis is fractional liquid volume pumped while the horizontal axis is HP pump duty cycle.

An ideal curve 419 is shown, which represents an HP pump with perfect valves and no compliance of the fluid (fuel in this case), which is equivalent to the fluid having an infinite bulk modulus. Ideally, for each unit duty cycle increase, the fractional liquid volume pumped also increases by one unit. The realistic, tested HP pump curves are shown in FIG. 4 as curves 428, 438, 448, 458, and 468. The slope 417 of ideal curve 419 is the same slope of every other curve in FIG. 4. The points 453 where the five realistic curves cross the horizontal (HP pump duty cycle) axis are the zero flow rate data, as the fractional liquid volume pumped along the horizontal axis is 0. Depending on the fuel system, HP pump, and other components, the spacing between the realistic curves changes, which is also a result of spill valve timing error, as seen below.

Figure 5:
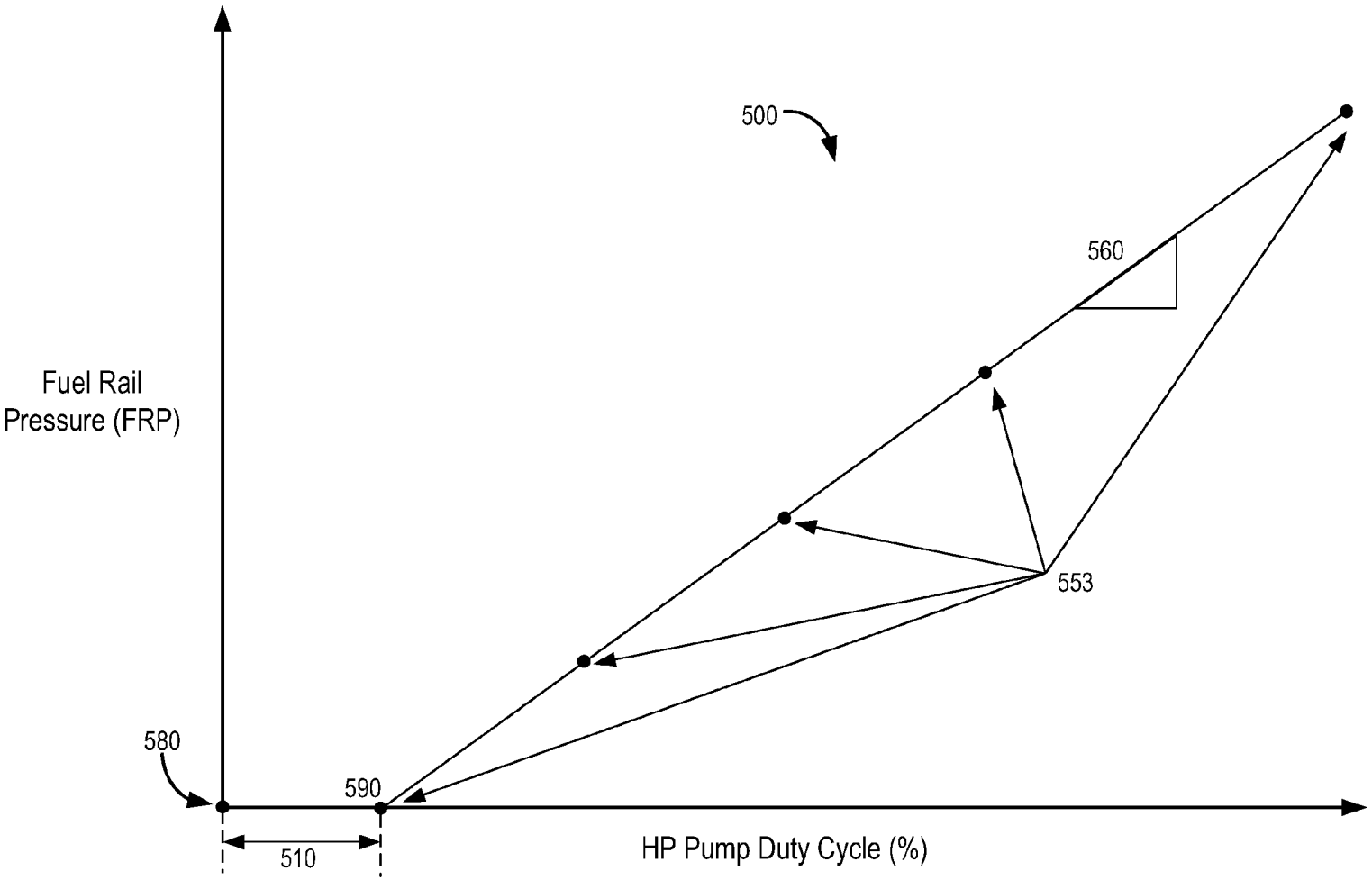
FIG. 5 illustrates the zero flow rate data of FIG. 4 plotted on a separate graph.

Since points 453, or intercepts 453, represent zero flow rate data for a particular HP pump, they can be plotted on a different graph. Each intercept (intersection) contains three values, wherein one value, fractional liquid volume pumped=0, is shared amongst all intercepts. The other two values are HP duty cycle and fuel rail pressure. Therefore, turning now to FIG. 5, the intercepts can be plotted on a graph 500 showing fuel rail pressure as a function of HP pump duty cycle. Intercepts 453 of FIG. 4 are shown in FIG. 5 as points 553. From plot 500, also known as the zero flow function since points 553 correspond to a zero flow rate, a slope 560 can be determined. The zero flow rate function is a relationship between fuel rail pressure and HP pump duty cycle, wherein the fractional liquid volume pumped is 0. As seen by the line formed by points 553, plot 500 (the zero flow rate function) intercepts the horizontal axis at intercept 590, which in this case is coincident with one of the points 553, the point corresponding to 0 bar fuel rail pressure (428 in FIG. 4).

An origin 580 of plot 500 is labeled in FIG. 5, where the origin coincides with the intersection of the vertical and horizontal axes, or FRP=0 and duty cycle=0. Ideally, intercept 590 would lie coincident with origin 580, where any increase in pump duty cycle corresponds to an increase in fuel rail pressure, exhibiting proper synchronization between spill valve timing and driving cam angular position. However, as seen in plot 500, intercept 590 lies along the horizontal axis at a positive duty cycle value, where the horizontal distance between intercept 590 and origin 580 is labeled as offset 510. For the range of duty cycle values (or closing of the spill valve) located within the range of offset 510, responsive fuel rail pressure remains unchanged. One reason for offset 510 is the volume loss that occurs in the check valves of pump 228, such as check valve 416. This volume loss may occur as the check valves switch between their open and closed states, wherein a small amount of backflow is needed to seal the check valves closed. The volume loss (due to non-ideal valving of the check valves) may be a near-constant value of about 2% of pump displacement The other reason for offset 510 is mistiming is present between the compression stroke of pump piston 406 and closing timing of spill valve 412, or spill valve timing error, as previously described.

A simple method based on graph 500 may be employed to correct spill valve timing error. As an example, if intercept 590 has a 2% duty cycle value instead of the ideal 0%, 2% may be added to the duty cycle, which corresponds to shifting the spill valve closing operation by advancing closing of the spill valve ahead of its normal operation. As such, in any HP pump system where different fuel rail pressures and slopes are found in FIGS. 4 and 5, the horizontal-axis intercept 590 and corresponding offset 510 of FIG. 5 may be used. It is noted that the error as represented by offset 510 is a positive error. In another situation (not shown), intercept 590 may correspond to a negative duty cycle value, lying to the left of origin 580. In this situation, the error represented by offset 510 would be a negative error, wherein correction would be performed by delaying closing of the spill valve behind its normal operation.

Now, a practical method is needed to find the data of FIG. 5, a method that can be utilized on-board the vehicle and continually employed to correct spill valve timing error. The inventors herein have recognized that this can be accomplished with two methods. Throughout the two methods described below, values are determined (recorded) via sensors or other devices that are attached to controller 12.

Figure 6:
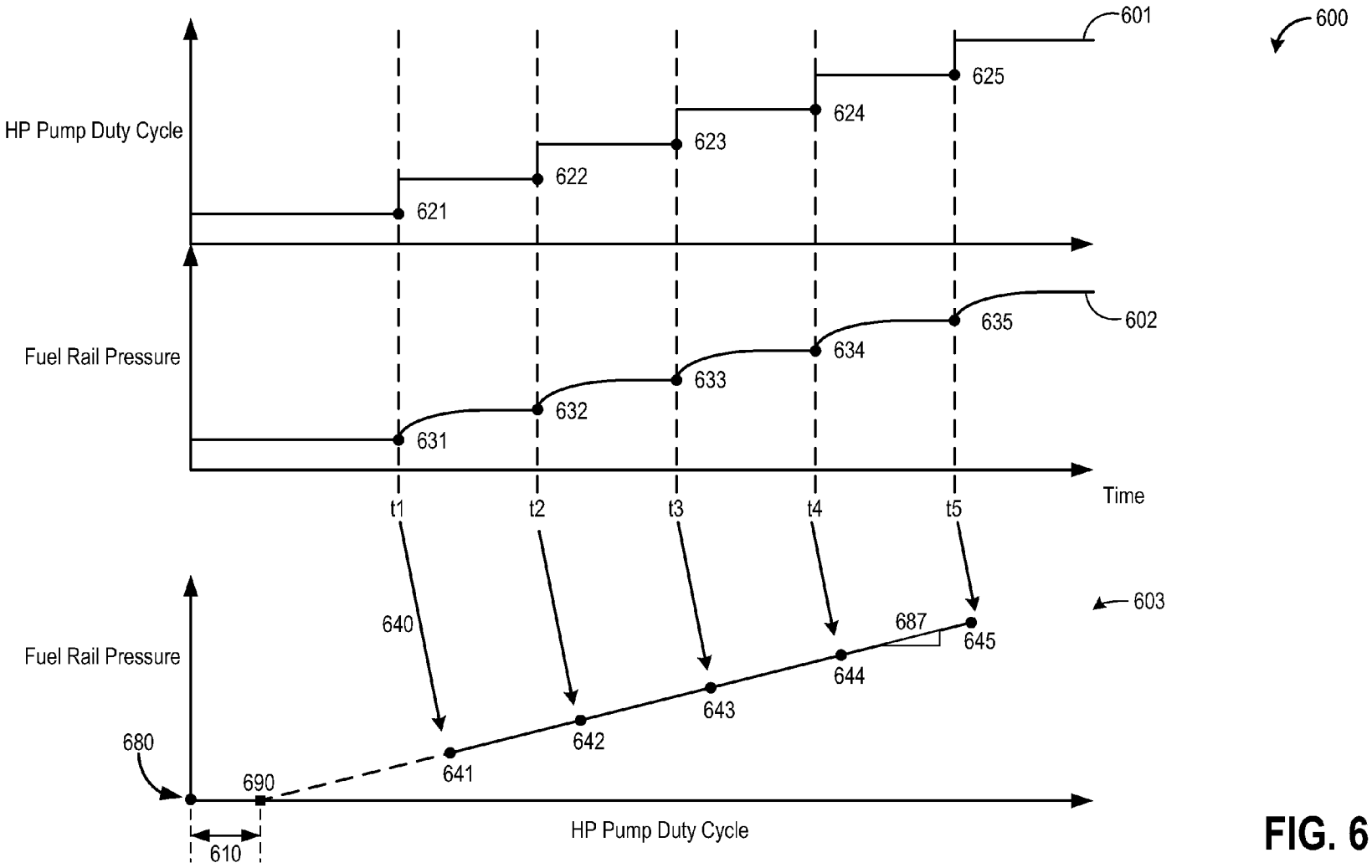
FIG. 6 shows a first method for correcting spill valve timing error.

FIG. 6 graphically illustrates a first method 600 for finding the data necessary to correct spill valve timing error. In this method, data is gathered while not direct injecting fuel into the engine, also known as zero injection flow rate. In engines that utilize both port and direct fuel injection, an engine is put into a stabilized idling condition where there is no fuel being pumped into the fuel rail that is coupled to HP pump 228. Method 600 shows commanded changes in pump duty cycle in plot 601 and the responsive changes in fuel rail pressure in plot 602. In plots 601 and 602 time is represented along the horizontal axis. Plot 603 shows how fuel rail pressure changes as a function of pump duty cycle. Plot 603 may also be referred to as the zero flow function, in that plot 603 shows a relationship between fuel rail pressure and duty cycle with a 0 flow rate.

The sequence of events according to method 600 of FIG. 6 is as follows: first, prior to time t1, pump duty cycle is being nominally controlled and thereby creating a response in fuel rail pressure. At time t1, a first pump duty cycle 621 is commanded and recorded along with the corresponding fuel rail pressure 631. Upon recording the values, duty cycle is increased to 622 and held for a time in between times t1 and t2. During this interval, the fuel rail pressure responds and gradually increases compared to the immediate increase in pump duty cycle. Due to the slow response of fuel rail pressure, the time interval to wait before taking second recordings may be 10 seconds, or until the fuel rail pressure reaches a steady-state value. After a time interval has elapsed (such as 10 seconds), the increased duty cycle 622 is recorded along with the steady-state fuel rail pressure 632 at time t2. The duty cycle is again incrementally increased to 623 and the same amount of time elapses before recording duty cycle 623 and the responsive steady-state fuel rail pressure 633 at time t3. As seen in FIG. 6, this same process is repeated at times t4 and t5. In this example method, five data points are recorded, each data point comprising a duty cycle value and a fuel rail pressure value.

Since each of the data points contains two values (duty cycle and fuel rail pressure), the five data points may be plotted on the separate graph 603 where HP pump duty cycle is the horizontal axis and fuel rail pressure is the vertical axis. Each data point is plotted as its corresponding point on graph 603. For example, the data point containing duty cycle 621 and fuel rail pressure 631 is plotted as point 641 on graph 603, as directed by arrow 640. Similar to FIG. 5, from graph 603 a slope 687 can be determined. As seen in FIG. 6, graph 603, or the zero flow function, is similar to graph 500 of FIG. 5 but with a key difference. The key difference is that a point with 0 fuel rail pressure is not present in graph 603. The reason for this is that some fuel systems may implement a lower threshold on fuel rail pressure and not allow the DI pump to operate below that threshold, even while in a zero flow rate mode. In this case, the lowest fuel rail pressure is shown as point 641. Nevertheless, since points 641, 642, 643, 644, and 645 lie along a straight line, the straight line may be extended according to slope 687, meeting the horizontal axis at intercept 690. With intercept 690 and offset 610, the horizontal distance between intercept 690 and origin 680 can be determined. As explained with regard to FIG. 5, the offset 610 may be used to correct the timing error of the spill valve.

Figure 7:
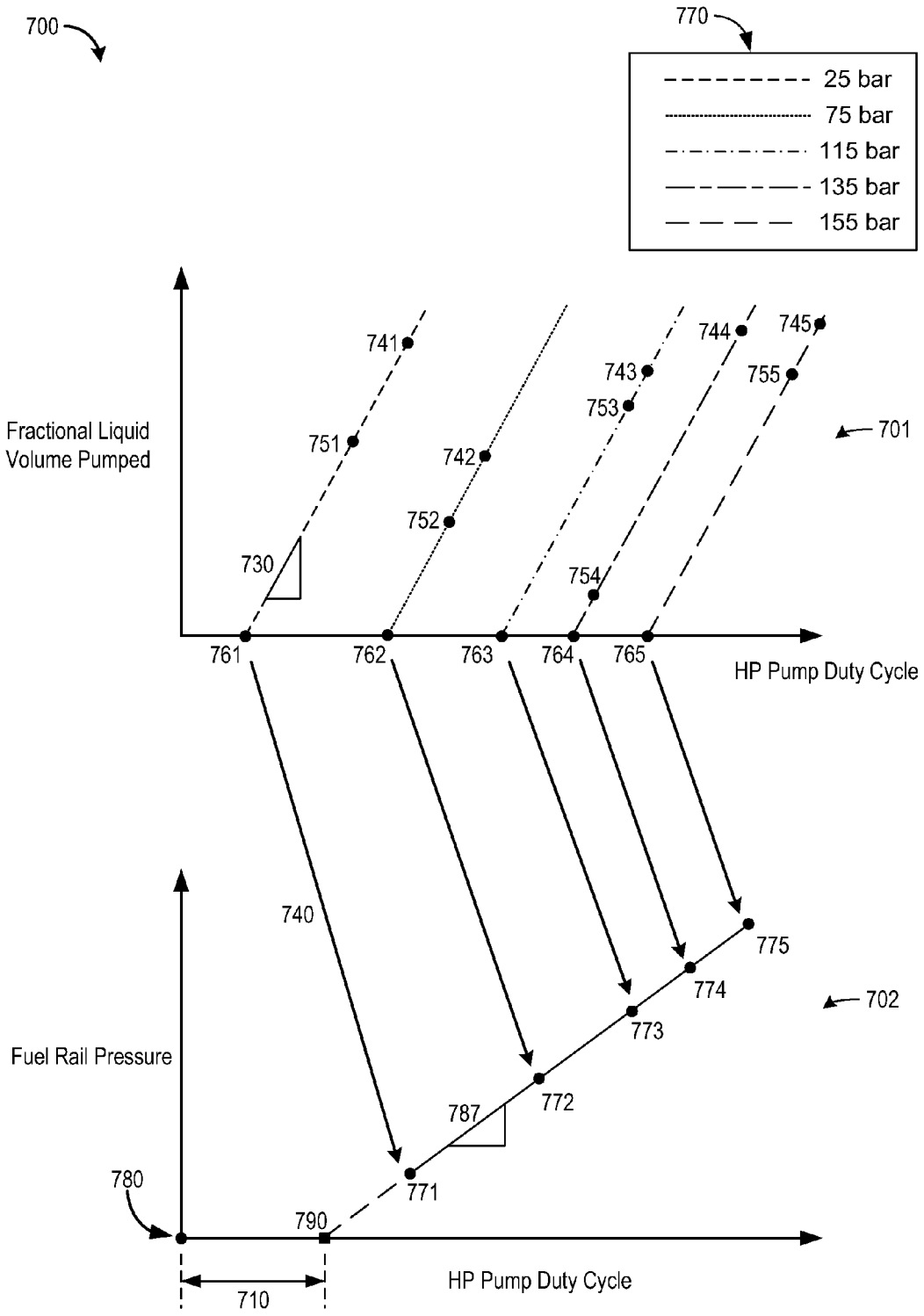
FIG. 7 shows a second method for correcting spill valve timing error.

Turning now to FIG. 7, a second method 700 is graphically shown for finding the data necessary to correct spill valve timing error. In this method, data is gathered while normally direct injecting fuel into the engine and maintaining a positive fuel flow rate, opposite to method 600 where direct injection is disabled to collect data. Method 700 utilizes a series of selected HP pump operating points, regresses those points to find intercepts, and plots the intercepts on a separate plot. Method 700 shows a mapping of several operating points of the HP pump in plot 701 and plot 702 displays how fuel rail pressure changes as a function of pump duty cycle. Plot 702 may also be referred to as the zero flow function (similar to plot 603), in that plot 702 is a relationship between fuel rail pressure and duty cycle with a 0 flow rate. Plot 701, displaying fractional liquid (fuel) volume pumped versus pump duty cycle, is similar to graph 400 shown in FIG. 4.

The sequence of events according to method 700 of FIG. 7 is as follows: first, an operating point 741 is chosen at a certain FRP, in this case 25 bar as seen in legend 770. Another operating point 751 is chosen at the same FRP (25 bar) but at a different duty cycle and fractional liquid volume pumped, so the two operating points 741 and 751 lie along a common line defined by the FRP. Physically, this is implemented as choosing a target FRP and duty cycle for the HP pump to operate at, then recording the responsive fractional liquid volume pumped, resulting in point 741. Next, pump duty cycle is adjusted while maintaining the same FRP so a second operating point 751 can be recorded, corresponding to a different fractional liquid volume pumped. Since two points define a line, a slope 730 can be calculated from the graphical position of points 741 and 751 (a pair of operating points). Using the equation of the line defined by FRP (25 bar), a point 761 can be calculated (extrapolated or regressed) as the point at which the line crosses the horizontal axis, or when fractional liquid volume pumped is 0 (zero flow rate data). Point 761 may also be referred to as a horizontal-axis intercept that corresponds to a zero flow rate data point based on a known line slope (slope 730). In a similar fashion, other pairs of operating points associated with other FRP (as shown in legend 770), including 742, 752; 743, 753; 744, 754; 745, and 755 forming a dataset, may be commanded by the HP pump and used to find intercepts 762, 763, 764, and 765. Each operating point (742, 752, etc.) consists of a duty cycle, fuel rail pressure, and fractional volume pumped. Furthermore, slope 730 is a slope of the dataset and may be the same for each pair of operating points.

Since intercepts 761, 762, 763, 764, and 765 represent the zero flow rate data of the HP pump, those intercepts can be plotted on a separate graph 702. For example, intercept 761 which contains three values (duty cycle, FRP, and 0 volume pumped) can be plotted on graph 702 as point 771, as directed by arrow 740. This same process can be applied for plotting the other points of graph 702, including points 772, 773, 774, and 775. Similar to FIG. 6, from the line formed by the five points, a slope 787 can be determined. As seen, there is no data available for a 0 FRP, as may be the case with some fuel systems. In FIG. 7, the lowest FRP is exhibited by point 771. Therefore, the line defined by the five data points with slope 787 may be extended to meet the horizontal axis at intercept 790. Numerically, intercept 790 may be found by using a form of the equation of a line. As origin 780 defines 0 FRP and 0 duty cycle, an offset 710 can be determined that spans the horizontal distance between intercept 790 and origin 780. As explained previously, offset 710 may be used to correct the timing error of the spill valve.

The first and second methods as graphically shown in FIGS. 6 and 7 share similar processes for finding intercepts 690 and 790 from plots 603 and 702, respectively, but they differ in their processes for finding the points that define the lines of zero flow functions 603 and 702. Flow charts illustrating the processes of the first and second methods can be seen in FIGS. 8 and 9.

Figure 8:
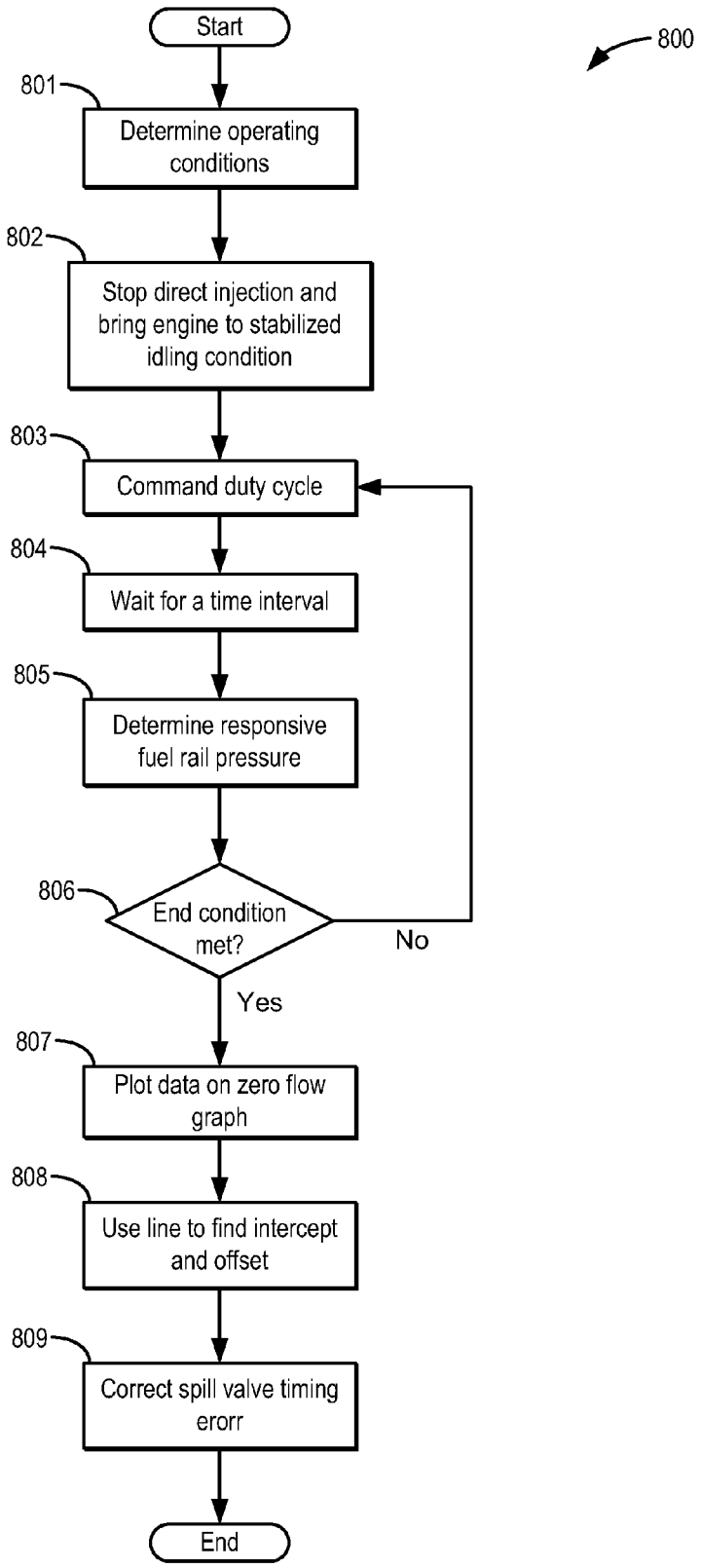
FIG. 8 depicts a flow chart of the process for correcting spill valve timing error as seen in FIG. 6.

FIG. 8 shows the flow chart for the first correction method 800. Beginning at 801, a number of operating conditions for the fuel and engine system are determined. These vary depending on the system, and may include factors such as current engine speed (as related to driving cam 410), engine fuel demand, boost, driver demanded torque, engine temperature, air charge, etc. Second, at 802, the HP pump ceases direct injecting fuel into the engine and the engine is set to a stabilized idling condition. In some engine systems, the idling condition may involve injecting fuel via port injection only. In this state, the HP pump is still operational but is in a zero flow state which may involve lubricating the pump to decrease pump degradation. After an idling condition is established, a duty cycle is commanded at 803. Although the duty cycle may be changed near-instantaneously (as shown by plot 601 in FIG. 6), the responsive FRP gradually changes. Upon waiting for a time interval at 804 that may depend on the particular engine and fuel system, the responsive, steady-state FRP is determined (recorded) at 805. At 806 an end condition must be met to progress to the next step. The end condition may be a minimum amount of data gathered, where each data point comprises a duty cycle and FRP. Alternatively, the end condition may be a minimum amount of elapsed time for collecting data or an upper threshold duty cycle is reached. Before that condition is met, several steps are repeated as seen in FIG. 8 to gather more data, each with a continually increasing commanded duty cycle. Once the end condition is met, the gathered data is plotted on a zero flow graph at 807, wherein the horizontal axis is duty cycle and vertical axis if FRP. Lastly, the plotted data is used to find the horizontal-axis intercept and offset at 808, and the offset is used to correct spill valve timing error at 809. It is noted that collecting more data points in steps 803-805 may increase the accuracy of the line formed by those data points as plotted in step 807.

Figure 9:
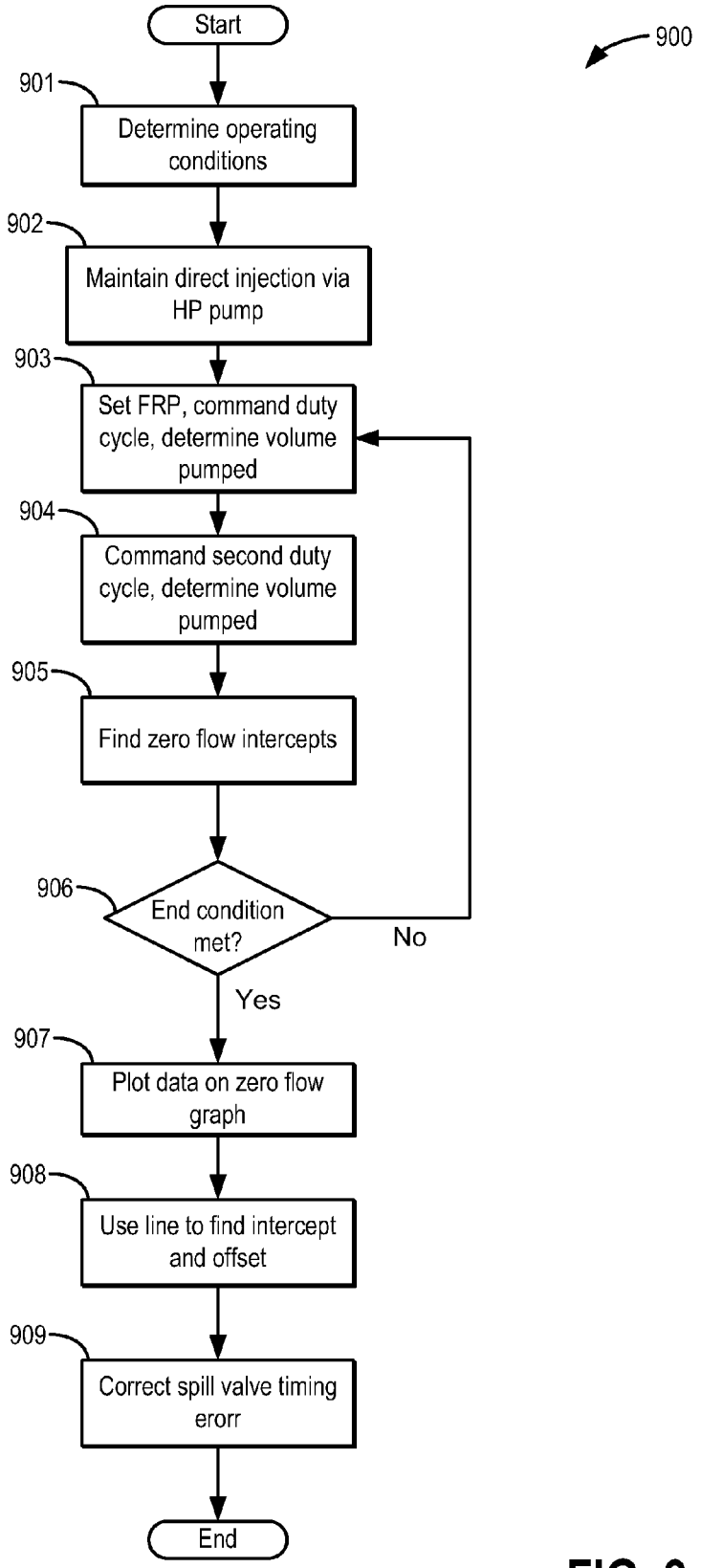
FIG. 9 depicts a flow chart of the process for correcting spill valve timing error as seen in FIG. 7.

FIG. 9 shows the flow chart for the second correction method 900. Beginning at 901, a number of operating conditions for the fuel and engine system are determined. These vary depending on the system, and may include factors such as current engine speed (as related to driving cam 410), engine fuel demand, boost, driver demanded torque, engine temperature, air charge, etc. Second, at 902, direct fuel injection into the engine is maintained by the HP pump, thereby creating a positive fuel flow rate. Next, at 903, an FRP is chosen and a duty cycle is commanded while recording the responsive fractional liquid fuel volume pumped. Since another operating point is needed to define a line, a second duty cycle is commanded at 904 and the fuel volume pumped is again recorded while maintaining the same FRP. Note that additional operating points may be collected at the same FRP. From the operating points, a line is defined that is regressed to find the zero flow intercepts at 905. At 906 an end condition must be met to progress to the next step. The end condition may be a minimum number of tested fuel rail pressures or a minimum amount of elapsed time for collecting data. Before that condition is met, several steps are repeated as seen in FIG. 9 to gather more data, each with a continually increasing FRP and/or commanded duty cycle. Once the end condition is met, the gathered data is plotted on a zero flow graph at 907, wherein the horizontal axis is duty cycle and vertical axis is FRP. Steps 907-909 are identical to steps 807-809 of FIG. 8. Upon finding the horizontal axis intercept and offset at 908, that data is used to correct spill valve timing error at 909. It is noted that collecting more data points in steps 903-905 may increase the accuracy of the line formed by those data points as plotted in step 907.

As previously described, correcting spill valve timing error at steps 809 and 909 may involve accelerating or delaying the operation of spill valve 412 in order to correct mistiming between when the spill valve nominally closes and actuation of pump piston 406 during its compression stroke. The processes 800 and 900 as described by the flow charts in FIGS. 8 and 9 may be repeated according to an external control scheme of controller 12. As an example, processes 800 and 900 may be initiated once every predetermined time interval, such as 30 seconds. In another example, the processes may be initiated if abnormal HP pump operation is detected that could signify spill valve timing error. As seen, a number of possibilities exist for determining when the correction methods of FIGS. 8 and 9 are repeated.

It is noted that the first correction method 800 of FIG. 8 is a more direct approach to finding the zero flow graph at 807 (zero flow function 603 of FIG. 6) than finding the zero flow graph at 907 of FIG. 9 (zero flow function 702 of FIG. 7) according to the second correction method 900. The reason is that the DI pump is already operating at a zero flow rate in the first correction method whereas a positive flow rate is present for the second correction method. However, in the first correction method the time interval in between times t1, t2, t3, t4, and t5 may sum to a long time period for finding the zero flow rate data of plot 603. The second method may require a lower amount of time than the first correction method due to extrapolating the data, but the extrapolation process itself (regression) may be more complex than the steps required in the first method.

It is understood that the two correction methods described in FIGS. 8 and 9 as shown by the graphs in FIGS. 6 and 7, respectively, are meant to present the general concept of adjusting pump duty cycle (spill valve timing) to quantify the relationship between pump duty cycle and FRP in a non-limiting sense. Various aspects of the two correction methods may be modified while still finding the relationship necessary to correct spill valve timing error. For example, five operating points were used in FIG. 6 when that number may vary depending on the particular fuel system. Also, the pressures used in FIG. 7 shown by legend 770 may be changed in a similar fashion. The correction methods may be modified to better suit a particular fuel system while following the same general scheme as previously explained.

In this way, spill valve timing error may be corrected on-board the vehicle without requiring additional peripheral components, thereby reducing the cost of the fuel system as compared to other correction methods. Furthermore, this may allow the complexity of the control system of the vehicle to be reduced, thereby also reducing power consumption and cost of the control system. Also, the described spill valve timing correction methods may monitor and analyze data produced by the fuel system in different operating modes without invasively disrupting the fuel system. The operating modes may include various fueling conditions such as engine idling, fueling the engine via port fuel injection only, and others. Depending on how often the correction methods are commanded to analyze the direct injection pump (to attain zero flow rate data), the timing of the spill valve may be maintained within a margin of its ideal operation. This may result in more efficient and reliable operation of the direct injection fuel pump, as well as better alignment between predicted and actual pump and injector performance.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting a duty cycle of a high pressure pump to correct a timing error of a spill valve based on a determined offset of a zero flow function for the high pressure pump, the spill valve regulating fuel flow into a compression chamber of the high pressure pump and the zero flow function based on a change in pump duty cycle relative to a resulting change in fuel rail pressure.

2. The method of claim 1, wherein determining the zero flow function for the high pressure fuel pump includes:

while not direct injecting fuel into an engine and while the engine is in a stabilized idling condition, commanding a first pump duty cycle;

waiting until fuel rail pressure reaches a steady-state value and then determining a first fuel rail pressure;

then commanding a second, higher pump duty cycle and determining a second fuel rail pressure; and continue increasing the pump duty cycle incrementally and determining fuel rail pressure until an upper duty cycle threshold is reached.

3. The method of claim 1, wherein determining the zero flow function for the high pressure fuel pump includes:

while direct injecting fuel into an engine to maintain a positive fuel flow rate, commanding a multitude of pump duty cycles corresponding to a multitude of fuel rail pressures and determining a responsive fractional volume of liquid fuel pumped, thereby forming a dataset, wherein the dataset comprises a multitude of operating points, each operating point consisting of a duty cycle, fuel rail pressure, and fractional volume pumped; and determining a multitude of horizontal-axis intercepts that correspond to zero flow rate data based on a known line slope.

4. The method of claim 3, wherein the known line slope is a slope of the dataset, wherein a vertical axis is fractional liquid fuel volume pumped and a horizontal axis is pump duty cycle.

5. The method of claim 1, wherein the spill valve is a solenoid activated check valve that is coupled to an inlet of the high pressure pump, the spill valve further being energized and de-energized to control fuel flow into the high pressure pump.

6. The method of claim 1, wherein the high pressure pump duty cycle is a measure of a spill valve closing timing that controls an amount of fuel pumped into a fuel rail by the high pressure pump.

7. The method of claim 1, wherein the high pressure fuel pump is fluidly coupled to a direct fuel injector of an engine via a fuel rail positioned downstream of the high pressure fuel pump.

8. The method of claim 1, wherein the high pressure fuel pump is fluidly coupled downstream of the spill valve.

9. An engine system, comprising:

an engine;

a direct fuel injector configured to direct inject fuel into the engine;

a fuel rail fluidly coupled to the direct fuel injector;

a high pressure fuel pump fluidly coupled to the fuel rail;

a controller with computer readable instructions stored in non-transitory memory for:

adjusting a duty cycle of a high pressure pump to correct a timing error of a spill valve based on a zero flow function for the high pressure pump, the spill valve regulating fuel flow into a compression chamber of the high pressure pump and the zero flow function based on a change in pump duty cycle relative to a resulting change in fuel rail pressure, wherein determining the zero flow function for the high pressure fuel pump includes:

while direct injecting fuel into the engine to maintain a positive fuel flow rate, commanding a multitude of pump duty cycles corresponding to a multitude of fuel rail pressures and determining a responsive fractional volume of liquid fuel pumped, thereby forming a dataset, wherein the dataset comprises a multitude of operating points, each operating point consisting of a duty cycle, fuel rail pressure, and fractional volume pumped; and determining a multitude of horizontal-axis intercepts that correspond to zero flow rate data based on a known line slope.

10. The engine system of claim 9, wherein the known line slope is a slope of the dataset, wherein a vertical axis is fractional liquid fuel volume pumped and a horizontal axis is pump duty cycle.

11. The engine system of claim 9, wherein the spill valve is a solenoid activated check valve that is coupled to an inlet of the high pressure pump, the spill valve further being energized and de-energized to control fuel flow into the high pressure pump.

12. The engine system of claim 9, wherein the high pressure pump duty cycle is a measure of a spill valve closing timing that controls an amount of fuel pumped into the fuel rail by the high pressure pump.

13. An engine method, comprising:

while not direct injecting fuel into an engine via a high pressure pump and while the engine is in a stabilized idling condition, determining a relationship between a high pressure pump duty cycle and a fuel rail pressure; and finding an offset from the relationship to correct a timing error of a spill valve, the spill valve regulating fuel flow into a compression chamber of the high pressure pump, wherein determining the relationship includes:

incrementally increasing the pump duty cycle and waiting for a period of time before measuring a responsive fuel rail pressure for each pump duty cycle; and continue incrementally increasing the pump duty cycle until an upper threshold duty cycle is reached.

14. An engine method, comprising:

while direct injecting fuel into an engine to maintain a positive fuel flow rate, determining a relationship between a high pressure pump duty cycle and a fuel rail pressure; and finding an offset from the relationship to correct a timing error of a spill valve, the spill valve regulating fuel flow into a compression chamber of the high pressure pump, wherein determining the relationship further comprises:

selecting a multitude of operating points, each operating point including a pump duty cycle and a fuel rail pressure that correspond to a fractional fuel volume pumped;

regressing each operating point to find a multitude of intersections with a horizontal axis; and plotting the intersections on a graph.

15. The engine method of claim 14, wherein regressing each operating point involves finding a slope of a line based on pump duty cycle and fractional fuel volume pumped.

16. The engine method of claim 14, wherein the graph displays fuel rail pressure as a function of the high pressure pump duty cycle.

* * * * *